US005310368A

United States Patent [19]

Kamitake

[11] Patent Number: 5,310,368

[45] Date of Patent: May 10, 1994

[54] SEAL CONSTRUCTION FOR A PUMP OF A SMALL WATERCRAFT

[75] Inventor: Mikio Kamitake, Kobe, Japan

[73] Assignee: Kawasaki Jukogyo Kabushiki Kaisha, Kobe, Japan

[21] Appl. No.: 10,545

[22] Filed: Jan. 28, 1993

[30] Foreign Application Priority Data

Mar. 19, 1992 [JP] Japan ..... 4-063472

[51] Int. Cl.[5] ..... B63H 11/08

[52] U.S. Cl. ..... 440/38

[58] Field of Search ..... 60/221, 222; 440/38, 440/40-47; 277/168, 189

[56] References Cited

U.S. PATENT DOCUMENTS 4,541,808 9/1985 Ono et al. ..... 440/42

4,971,584 11/1990 Inoue et al. ..... 440/38

OTHER PUBLICATIONS

Kawasaki Jet Ski Watercraft Service Manual-JS 440; dated Mar. 1978.

Kawasaki Jet Ski Watercraft Training Manual-dated Mar. 3, 1987.

*Primary Examiner*—Edwin L. Swinehart

*Attorney, Agent, or Firm*—Marshall, O'Toole, Gerstein, Murray & Borun

[57] ABSTRACT

A seal construction for a pump of a small watercraft of the water jet propulsion type, the watercraft including a hull and a pump casing. A pumping passage for water jet propulsion is formed by the pump casing and a portion of the hull. The seal construction includes a flange formed on the pump casing, the flange having walls, and an elastic seal member liquid-tightly surrounding the periphery of the flange. The seal member has an outer periphery in liquid-tight contact with the inner surface of the hull portion where the pump is mounted. The flange and the seal member have parts for immovably engaging with each other.

4 Claims, 5 Drawing Sheets

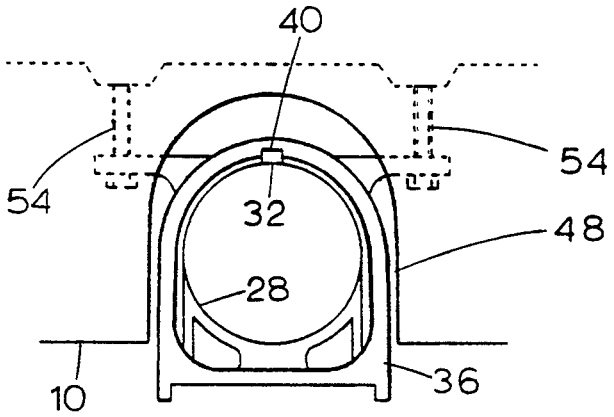
FIG. 2
FIG. 6
PRIOR ART
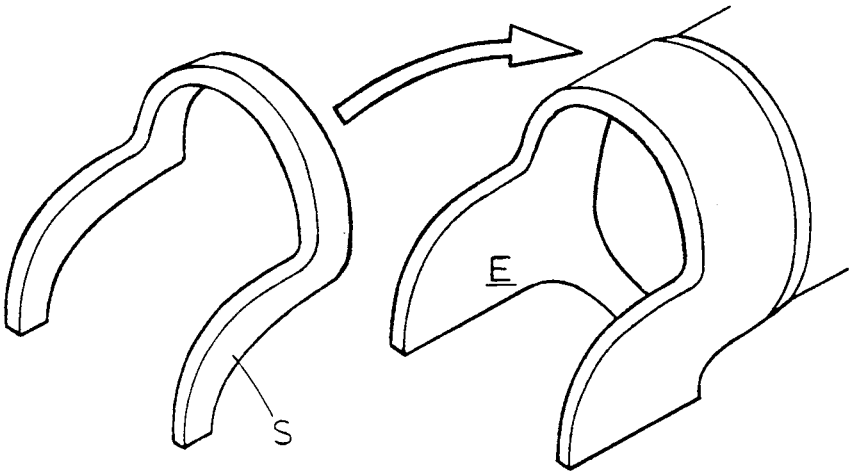

SEAL CONSTRUCTION FOR A PUMP OF A SMALL WATERCRAFT

FIELD AND BACKGROUND OF THE INVENTION

The present invention relates to a construction for mounting a pump on a small watercraft of the water jet propulsion type.

A prior art watercraft of this type is exemplified in FIG. 1 of U.S. Pat. No. 4,541,808, and includes a pump duct 6 connected to the wall of a recess 3 in the hull, the connection being exposed to the air in the recess 3 around the duct. If the connection does not form a good liquid-tight seal, when the watercraft is gliding on the water and has a shallow draft, air may be sucked through the connection and into the pump and cause the impeller 4 to idle. This, of course, lowers the pump performance.

The connection may be sealed with a flowable fluid packing, which solidifies in a predetermined time but still remains elastic. However, such packing is sticky and therefore makes the assembly of the parts difficult. It takes skill to apply the fluid packing with a predetermined and uniform thickness to the connecting surfaces. Also, it takes time and requires an additional process step to apply a fluid packing when the pump is assembled, and to replace the packing when the pump is overhauled.

FIG. 6 of the accompanying drawings shows other prior art constructions, wherein, instead of fluid packing, a rubber seal member S is interposed on the front end E of the pump casing, which is the connecting part. However, because the member S and part E do not have stable shapes and means for locating the member S in place on the part E, the seal member may not be located precisely in place when the assembly is completed, so that the seal is not completely liquid-tight.

It is an object of the present invention to provide a construction for mounting a pump on a small watercraft of the water jet propulsion type, wherein the pump can be mounted with a seal member in a liquid-tight connection easily, quickly and reliably without skill, and wherein the seal member can be used again when the pump is overhauled.

SUMMARY OF THE INVENTION

According to this invention, a construction is provided for mounting a pump on a small watercraft of the water jet propulsion type, which includes a hull and a pump casing, and in which a pumping passage for propulsion water is formed by the pump casing and a portion of the hull.

The construction comprises a flange formed on the pump casing, and an elastic seal member liquid-tightly surrounding the periphery of the flange. The outer periphery of the seal member liquid-tightly contacts the inner surface of the hull portion, at the location where the pump is mounted. The flange and the seal member include means for immovably engaging with each other for locating the seal on the flange.

BRIEF DESCRIPTION OF THE DRAWINGS

Preferred embodiments of the invention are shown in the accompanying drawings, wherein:

FIG. 2 is a schematic view in section taken along line 2—2 of FIG. 1, and showing some parts in the process of being mounted;

FIG. 6 is a perspective view showing parts of a prior art watercraft.

DETAILED DESCRIPTION OF THE DRAWINGS

Figure 1:
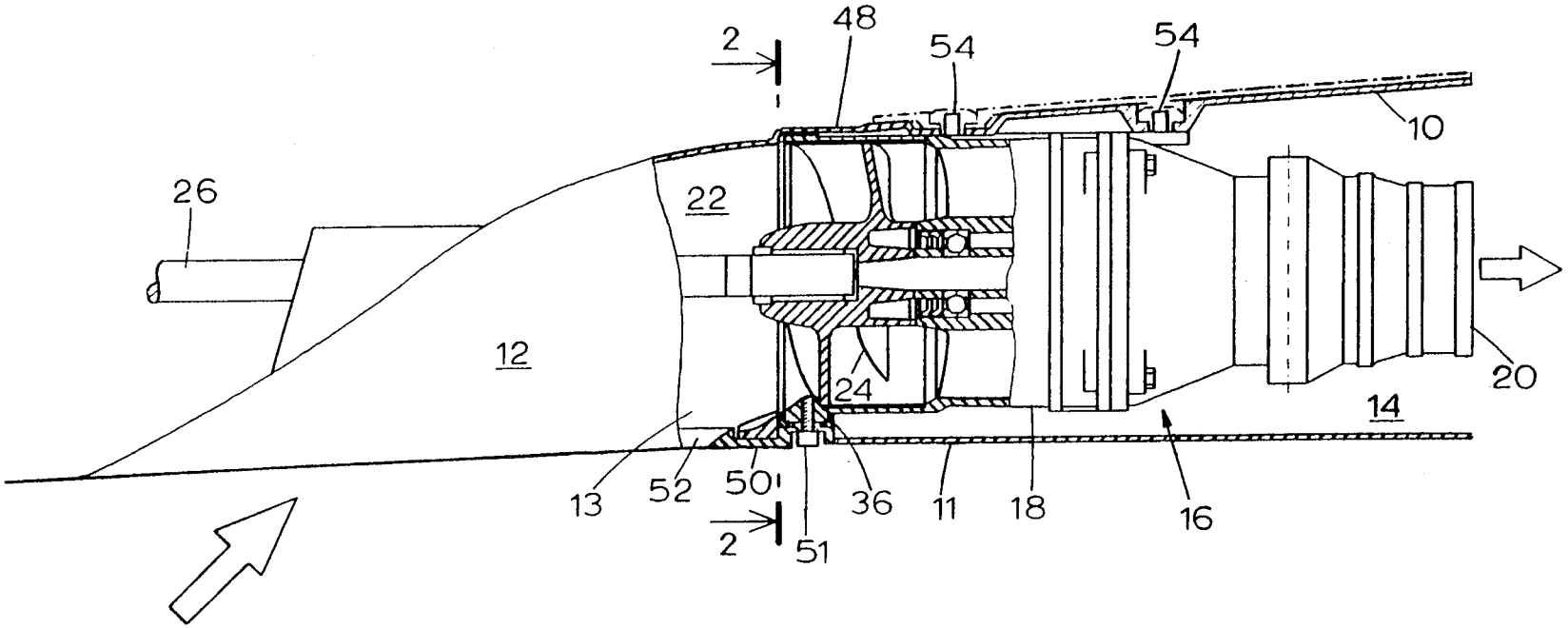
FIG. 1 is a fragmentary side view partially in section of a small watercraft of the water jet propulsion type, including a construction for mounting a pump in accordance with this invention.
Figure 3:
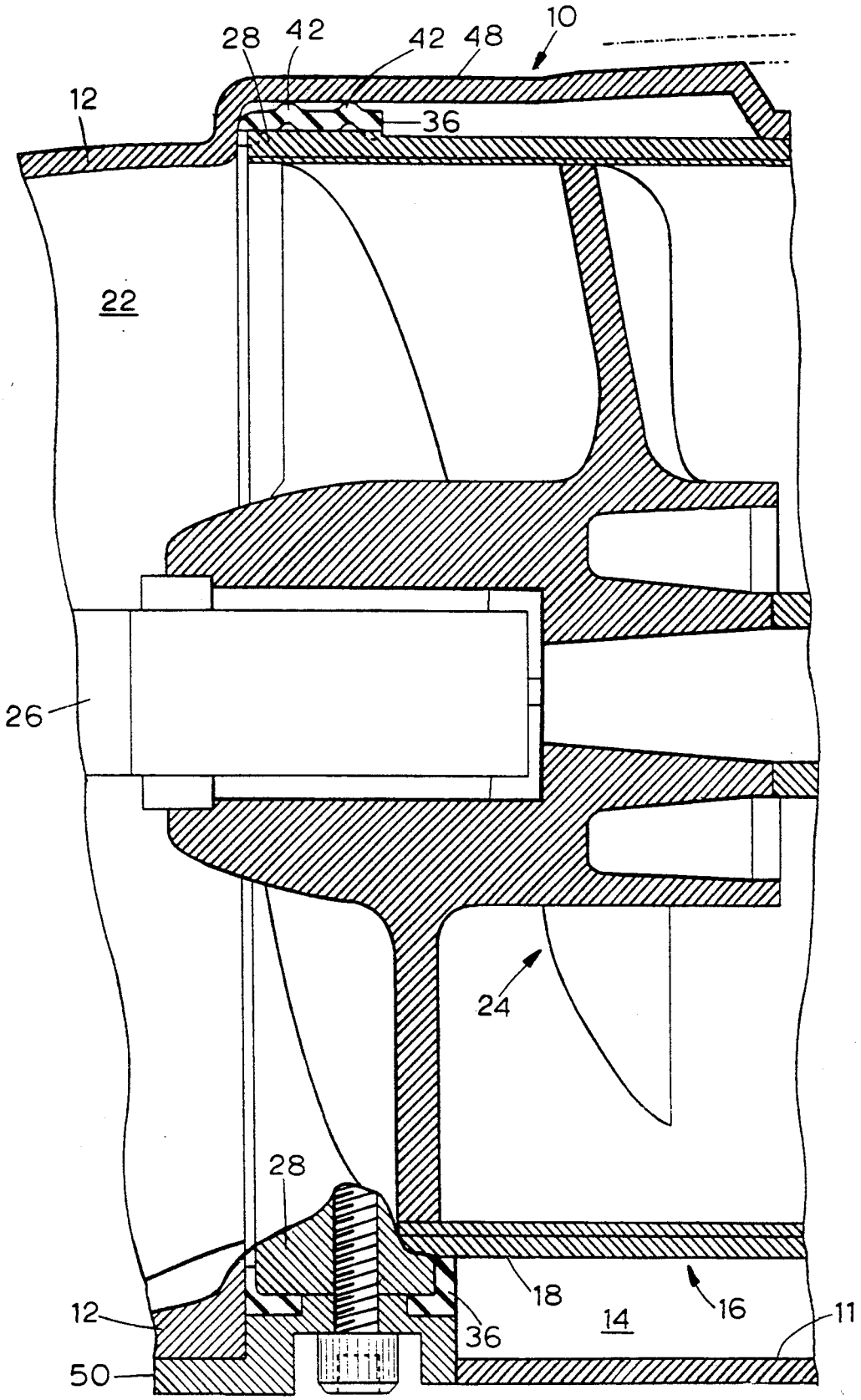
FIG. 3 is an enlarged sectional view of part of FIG. 1.

With reference to FIGS. 1–4, the watercraft includes a hull 10, only the bottom portion of which is shown. A suction duct 12 having an inlet port 13 (FIG. 4) is formed in the hull bottom. As shown in FIGS. 1 and 3, the hull 10 and a pump bottom cover 11 bolted to it form a pump chamber 14, which houses a jet propulsion pump 16 including a casing 18 and an outlet port 20.

The suction duct 12 and the pump casing 18 are interconnected to form a pumping passage 22 extending from the duct inlet 13 to the pump outlet 20.

The pump 16 includes an impeller 24 coupled by a propeller drive shaft 26 to an engine (not shown) mounted in the hull to produce a propulsive force by sucking water from the inlet 13 and discharging it in a jet from the outlet 20.

When the watercraft is planing or gliding on the water, the draft is shallow and there is little or no water in the pump chamber 14, and there is a negative pressure in the portion of passage 22 upstream of the impeller 24. If the connection between the duct 12 and the pump casing 18 is not liquid tight, air would be sucked from the pump chamber 14 around the casing 18 through this connection into the inlet 13 and then into the pump 16. As a result, the air would cause the impeller 24 to idle and the engine would overspeed.

Figure 4:
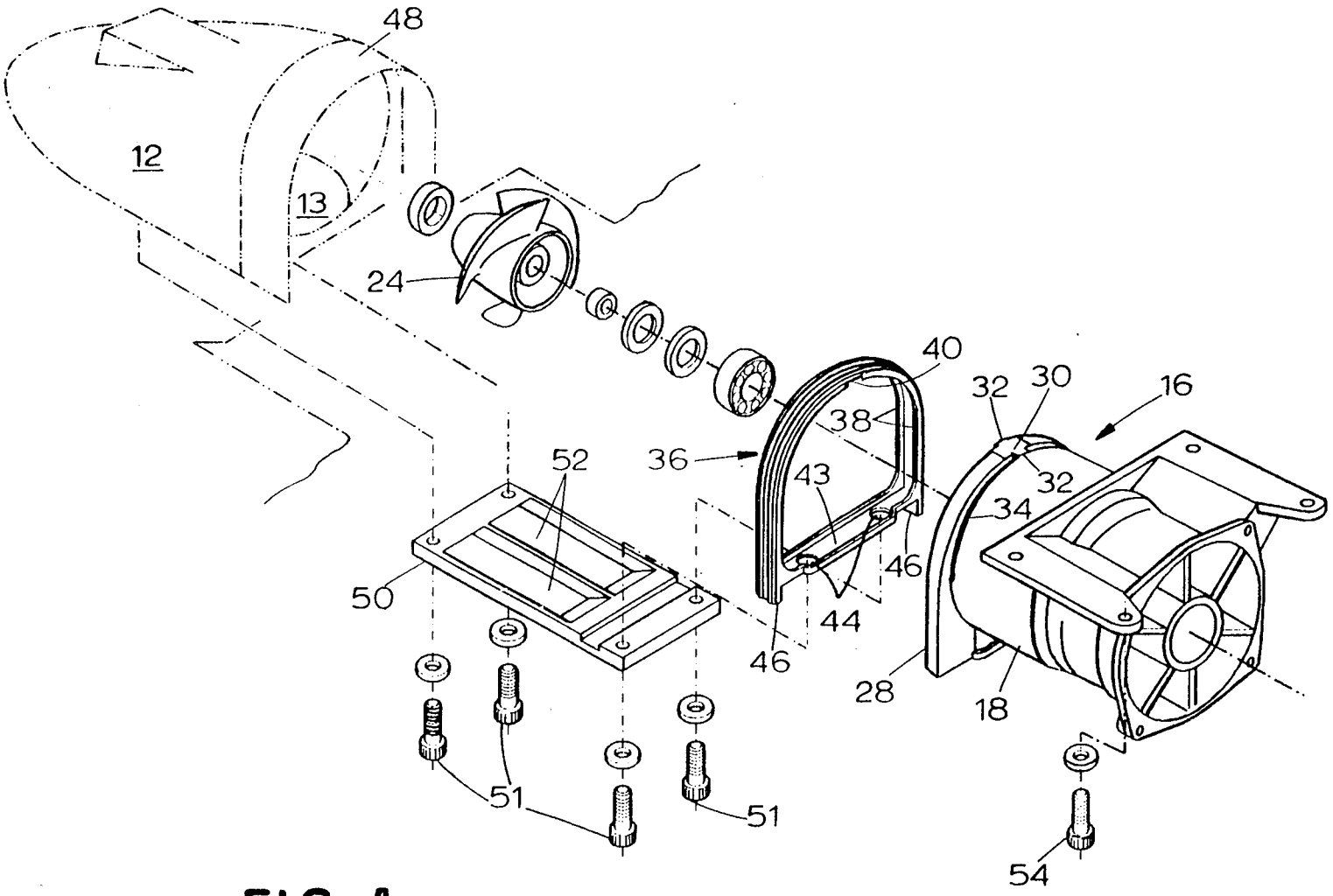
FIG. 4 is an exploded perspective view of parts of the watercraft shown in FIG. 1.

The pump casing 18 has at its front end (the upstream end) a flange 28 substantially in the shape of an inverted U (see FIGS. 2 and 4). The flange 28 widens slightly toward the bottom as shown in the end view (FIG. 2). The flange 28 has a flat top 30 (FIG. 4) formed with front and rear projections 32.

The pump casing 18 is formed with peripheral grooves 34 adjacent its front end (FIG. 4), which define part of the rear wall of the flange 28. The grooves 34 extend from the rear projection 32 substantially along the upper circular sides of flange 28. The lower ends of the grooves 34 gradually become shallow and merge into the peripheral wall of casing 18.

As shown in FIG. 4, a seal member 36 of rubber or other elastic material has a shape corresponding to the outer surface of the flange 28, and surrounds the flange 28 in a liquid-tight connection.

The seal 36 has two lips 38 projecting inwardly at its front and rear edges and immovably engaging with the front and rear walls of the flange 28 and the grooves 34. Each lip 38 has a top recess 40 that engages with one projection 32 at the top of the flange 28. The seal 36 is sized and configured to fit snugly around the outer periphery of the flange 28.

When the seal 36 is manually placed around the flange 28, the engagement of the recesses 40 with the projections 32 distributes equivalent tensions to both right and left sides of the seal, thereby securing the placement of the seal and improving the liquid tightness.

The seal 36 has two outer ridges 42 (FIG. 3) on its outer periphery for a better liquid tight seal with the duct 12, and its bottom side 43 has bolt holes 44. The seal 36 also has short legs 46 at the ends of the bottom side 43.

The suction duct 12 has an expanded rear end portion 48 around and corresponding to the shape of the flange 28 (see FIG. 4), but slightly larger than the flange by the thickness of seal 36 when compressed. The bottom side, which may be under water when the watercraft is gliding, of the rear portion 48 is cut away to facilitate the mounting of pump 16.

The cut-away bottom side of rear portion 48 is covered by a rear portion of a grate 50, which forms part of the hull bottom. The grate 50 is bolted by bolts 51 to the bottom side of the flange 28 and has a liquid-tight connection through the seal 36 to the duct 12. The grate 50 has apertures or slits 52 at the duct inlet 13 to allow water to enter the duct but to prevent the suction of seaweeds or the like into the duct 12. The seal legs 46 seal the clearances between the grate 50 and both sides of duct rear portion 48.

The grate 50 may instead be replaced by a forward extension of the pump cover 11.

If the watercraft is designed to position the seal bottom side 43 under water even when the watercraft is gliding, the side 43 need not be liquid-tight.

After the seal 36 has been placed around the flange 28, the outer surface of seal 36 may be wetted with water or oil to reduce friction during assembly. Then, as shown in FIG. 2, the pump casing 18 is moved upwardly into the hull 10 and is bolted by bolts 54 to the upper hull 10, which forms the pump chamber 14.

Because the flange 28 and suction duct rear portion 48 widen in the downward direction as stated above, the pump 16 can be easily moved into place and bolted. Also, as the parts are being bolted (FIG. 2), the duct portion 48 gradually and uniformly compresses the seal 36 except for its bottom side 43. This improves the sealing.

Thus, by initially engaging the seal 36 in the predetermined relationship with the pump flange 28, the pump 16 can be mounted on the hull easily and smoothly with a perfect seal, without dislocation or drift of position. This allows one, even one who may not be skilled, to mount the pump easily with a highly reliable seal.

When the pump is overhauled, the pump 16 can be taken off the duct 12 in the reverse order without damaging the seal 36, which can therefore be used again.

FIGS. 5*a*–5*d* show upper sectional views of various configurations for immovably engaging the seal with the pump casing.

Figure 5A:
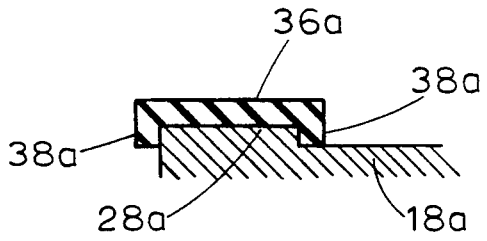
FIGS. 5*a*–5*d* are enlarged fragmentary views in section showing various engaging means each between a seal and a pump casing according to the invention.

In FIG. 5*a*, the pump casing 18*a* has an outer rectangular flange 28*a*. The front wall of flange 28*a* coincides with the front end of casing 18*a*. The seal 36*a* has peripheral lips 38*a* engaging with the front and rear walls of flange 28*a*.

Figure 5B:
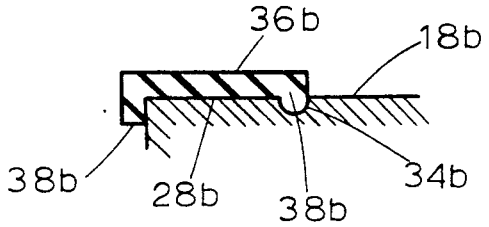

In FIG. 5*b*, the pump casing 18*b* has a flange 28*b* and a peripheral groove 34*b*, which defines part of the rear wall of flange 28*b*. The front wall of flange 28*b* coincides with the front end of casing 18*b*. The upper portion of flange 28*b* is flush with the casing 18*b*. The seal 36*b* has peripheral lips 38*b* engaging with the front and rear walls of flange 28*b* and the groove 34*b*.

Figure 5C:
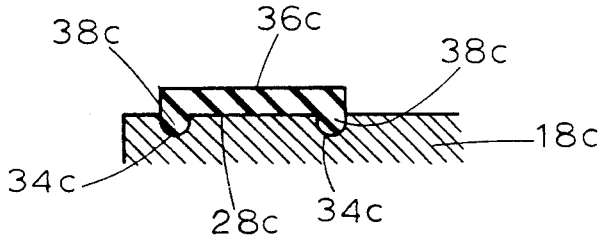

In FIG. 5*c*, the pump casing 18*c* has a flange 28*c* and two spaced apart peripheral grooves 34*c*, which each define part of the front or rear wall of flange 28*c*. The upper portion of flange 28*c* is flush with the casing 18*c*. The seal 36*c* has peripheral lips 38*c* engaging with the grooves 34*c*.

Figure 5D:
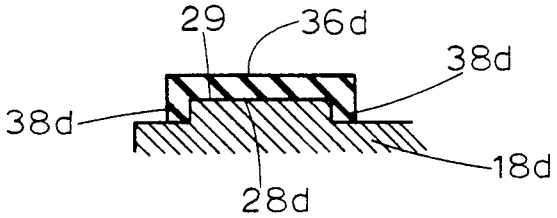

In FIG. 5*d*, the pump casing 18*d* has a flange 28*d*, which is spaced somewhat rearwardly from the front end of casing 18*d*. The seal 36*d* has peripheral lips 38*d* engaging with the front and rear walls of flange 28*d*.

Although the lower sections of the immovable engaging means of casings 18*a*–18*d* are not shown, they may take any of the forms shown in FIGS. 5*a*–5*d*. For example, in the FIGS. 1–4 embodiment, the upper section of the casing takes the form of FIG. 5*b*, while the lower section takes the form of FIG. 5*a*, and the grooves 34 gradually merge into the peripheral casing wall as explained previously. The seals shown in FIGS. 5*a* to 5*d* may also have outer ridges such as the ridges 42.

What is claimed is:

1. A construction for mounting a pump on a small water jet propulsion watercraft, the watercraft including a hull and a pump casing, and in which a pumping passage for water jet propulsion is formed by the pump casing and a portion of the hull, the construction comprising:

a flange formed on the pump casing and extending radially outwardly of said pump casing, the flange having walls, an elastic seal member liquid-tightly surrounding the periphery of the flange, the seal member having an outer periphery in liquid-tight contact with the inner surface of the hull portion where the pump is mounted, and the flange and the seal member having interengaging means for engaging with each other and preventing movement of said seal member around said pump casing.

2. A construction according to claim 1, wherein said immovably engaging means comprises inwardly projecting lips formed on said seal member and said walls of said flange, said lips engaging said walls of said flange.

3. A construction according to claim 2, wherein said immovably engaging means of the flange further comprises at least one peripheral groove formed in said casing, the groove defining part of one of said walls.

4. A construction according to claim 1, wherein said immovably engaging means of said flange comprises a projection extending int he forward-rearward direction, and said immovably engaging means of said seal member comprises a recess therein which receives said projection.

* * * * *